US011837384B2

(12) United States Patent
Zhang et al.

(10) Patent No.: US 11,837,384 B2
(45) Date of Patent: Dec. 5, 2023

(54) CORONA-RESISTANT ENAMELED ROUND WIRE AND PREPARATION METHOD THEREFOR

(71) Applicants: SHANGHAI XPT TECHNOLOGY LIMITED, Shanghai (CN); SUZHOU JUFENG ELECTRICAL INSULATION SYSTEM CO., LTD., Suzhou (CN)

(72) Inventors: Ling Zhang, Shanghai (CN); Xingwu Dai, Shanghai (CN); Yanjun Cai, Shanghai (CN); Ge Qin, Shanghai (CN); Lu Bi, Shanghai (CN); Yu Xia, Suzhou (CN); Cheng Zhou, Suzhou (CN); Guo Li, Suzhou (CN); Qingquan Lei, Suzhou (CN)

(73) Assignees: SHANGHAI XPT TECHNOLOGY LIMITED, Shanghai (CN); SUZHOU JUFENG ELECTRICAL INSULATION SYSTEM CO., LTD., Suzhou (CN)

( * ) Notice: Subject to any disclaimer, the term of this patent is extended or adjusted under 35 U.S.C. 154(b) by 0 days.

(21) Appl. No.: 17/885,643

(22) Filed: Aug. 11, 2022

(65) Prior Publication Data

US 2023/0047864 A1 Feb. 16, 2023

(30) Foreign Application Priority Data

Aug. 12, 2021 (CN) ..... 202110925433.8

(51) Int. Cl.

| | |
|---|---|
| ***H01B 7/02*** | (2006.01) |
| ***H01B 3/30*** | (2006.01) |
| ***H01B 3/42*** | (2006.01) |

(52) U.S. Cl.
CPC ..... *H01B 7/0225* (2013.01); *H01B 3/306* (2013.01); *H01B 3/421* (2013.01); *H01B 3/427* (2013.01)

(58) Field of Classification Search
CPC . H01B 3/30; H01B 3/301–3/308; H01B 3/36; H01B 3/38; H01B 3/421–3/427;
(Continued)

(56) References Cited

U.S. PATENT DOCUMENTS 3,474,186 A * 10/1969 Hale ..... H01B 9/023 174/109
3,582,532 A * 6/1971 Plummer ..... H02G 3/0487 174/DIG. 11
3,757,029 A * 9/1973 Marshall ..... H01B 7/08 174/117 FF (Continued)

FOREIGN PATENT DOCUMENTS

CN 111508639 6/2021

OTHER PUBLICATIONS

Extended Search Report for European Patent Application No. 22190156.4, dated Dec. 14, 2022, 7 pages.

*Primary Examiner* — William H. Mayo, III
(74) *Attorney, Agent, or Firm* — Sheridan Ross P.C.

(57) ABSTRACT

A corona-resistant enameled round wire and preparation method of making such which is suitable for electric vehicle motors and has a copper conductor and an insulating layer. The insulating layer clads the copper conductor and has in sequence from inside to outside, a corona- resistant polyamideimide coating, a corona-resistant special resin coating, a corona-resistant polyimide coating, a corona-resistant modified silicone resin coating, and a corona-resistant polyamideimide coating.

18 Claims, 4 Drawing Sheets

(58) Field of Classification Search
CPC ..... H01B 7/0216; H01B 7/29; H01B 7/292; H01B 7/30; H01B 3/00
USPC ..... 174/110 R, 110 PM, 110 FC, 120 R, 174/120 SR, 121 SR
See application file for complete search history.

(56) References Cited

U.S. PATENT DOCUMENTS 4,319,075 A * 3/1982 Willette ..... H01R 12/59 174/117 FF
4,323,721 A * 4/1982 Kincaid ..... H01B 11/06 428/189
4,327,246 A * 4/1982 Kincaid ..... H01B 11/1025 174/105 R
4,477,693 A * 10/1984 Krabec ..... H01B 11/1016 174/105 R
4,537,804 A * 8/1985 Keane ..... H01B 3/303 427/418
4,652,772 A * 3/1987 Shephard ..... H01B 7/0838 174/117 FF
4,855,534 A * 8/1989 O'Connor ..... H01B 13/2686 428/209
5,023,395 A * 6/1991 O'Connor ..... B32B 15/08 428/209
5,053,582 A * 10/1991 Terakawa ..... H01B 11/1025 174/109
5,552,565 A * 9/1996 Cartier ..... H01B 7/0892 174/117 FF
6,403,887 B1 * 6/2002 Kebabjian ..... H01B 11/1025 174/113 R
6,664,466 B2 * 12/2003 Bailey ..... H01B 11/1008 174/105 R
6,740,808 B1 * 5/2004 Chang ..... H01B 7/0861 174/113 R
8,916,775 B2 * 12/2014 Tamaki ..... H01B 11/1025 174/109
9,196,401 B2 * 11/2015 Oya ..... H01B 7/292
2012/0200268 A1 * 8/2012 Ye ..... H02M 1/4225 323/210
2015/0279510 A1 * 10/2015 Hanawa ..... H01B 7/0291 428/379
2019/0068020 A1 * 2/2019 Knerr ..... H02K 15/12

* cited by examiner

CORONA-RESISTANT ENAMELED ROUND WIRE AND PREPARATION METHOD THEREFOR

Cross-Reference to Related Application

This application claims the benefit of China Patent Application No. 202110925433.8 filed Aug. 12, 2021, the entire contents of which are incorporated herein by reference in its entirety.

TECHNICAL FIELD

The disclosure relates to the technical field of corona-resistant enameled round wires, and particularly to a corona-resistant enameled round wire suitable for electric vehicle motors and a preparation method therefor.

BACKGROUND ART

Introduction to the Prior Art: With the application of SiC and GaN high-power components, higher technical requirements have been put forward for insulating materials and systems for electric vehicle motors: frequency increase and ultra-high frequencies cause serious partial discharge and corona corrosion, increase dielectric loss and heat generation, and accelerate insulation electric heating aging; where the voltage increases and the rated voltage is ≥800 V, the generated high-frequency pulse spike voltage is much higher than the existing voltage values. There is an urgent need for an insulating material and system to improve the resistance to high-frequency spike voltages, which have a higher partial discharge inception voltage (PDIV) and partial discharge extinction voltage (PDEV).

The performance of a corona-resistant enameled round wire, as the main insulating material for electric vehicle drive motors, plays a decisive role in the service lifetime of a drive motor. As the rated voltage of the drive motor increases, the key is to improve the PDIV/PDEV value of the enameled round wire. At present, the PDIV value of the existing corona-resistant enameled round wire is basically about 900 V and the PDEV value is about 500 V, which cannot meet the technical requirements for the use of high-voltage drive motors. In addition, with the development of drive motors towards ultra-high frequencies, the corona resistance lifetime of enameled round wires needs to be further improved. Therefore, there is an urgent need for developing a corona-resistant enameled round wire with a high PDIV/PDEV value and a preparation method therefor in order to satisfy the technical demands for the development and application of high-voltage electric vehicle drive motors.

SUMMARY OF THE DISCLOSURE

(1) Objectives of the Disclosure

The technical problem to be solved by the disclosure is to provide a corona-resistant enameled round wire suitable for electric vehicle motors and a preparation method therefor in order to overcome the deficiencies of the prior art.

According to an embodiment, the disclosure provides a corona-resistant enameled round wire suitable for electric vehicle motors, the corona-resistant enameled round wire comprising a copper conductor and an insulating layer. The insulating layer clads the copper conductor and comprises, in sequence from inside to outside, a first corona-resistant polyamideimide coating, a corona-resistant special resin coating, a corona-resistant polyimide coating, a corona-resistant modified silicone resin coating, and a second corona-resistant polyamideimide coating.

Furthermore, the thickness percentages of the first corona-resistant polyamideimide coating, the corona-resistant special resin coating, the corona-resistant polyimide coating, the corona-resistant modified silicone resin coating, and the second corona-resistant polyamideimide coating are respectively 10-20%, 10-25%, 5-15%, 25-35%, and 10-25%.

Furthermore, the first corona-resistant polyamideimide coating, the corona-resistant polyimide coating, and the second corona-resistant polyamideimide coating can be formed by means of coating with a corona-resistant polyamideimide/polyimide paint prepared by modification with nano-silica, aluminum(III) oxide or a combination thereof.

Furthermore, the corona-resistant special resin coating can be formed by means of coating with a corona-resistant special resin paint liquid prepared by modification with nano-silica, aluminum(III) oxide or a combination thereof.

Furthermore, the corona-resistant special resin paint liquid can be selected from benzoxazine, polyarylene ether nitrile, polyarylene ether nitrile sulfone, polyether sulfone, modified polyether ether ketone, a cyanate ester prepolymer or a combination thereof.

Furthermore, the corona-resistant modified silicone resin coating is prepared by means of a preparation method involving: adding a certain amount of ethyl orthosilicate or butyl orthosilicate to a reaction flask, starting stirring, adding a hydroxy-containing polysiloxane with a fraction of 30-100% relative to the mass of the ethyl orthosilicate or butyl orthosilicate, and a catalyst with a fraction of 0.01-0.2% relative to the total material mass, raising the temperature to 140-150° C., and maintaining the temperature for a reaction; and when no alcoholic solvent is distilled out, performing evacuation to a vacuum of −0.09 MPa or more, maintaining the vacuum for 1-2 hours, and cooling the reaction material for later use; charging the material into a sealed homogeneous emulsification kettle, and adding butyl acetate to adjust the solid content to 50-60%; adding a certain amount of a nano-powder to the homogeneous emulsification kettle, starting stirring at a speed of 8000-12000 r/min for homogeneous dispersion to D50<100 nm, and starting cooling with jacket cooling water in the kettle to cause the temperature of the material in the kettle to be 60° C. or lower; and after cooling to 40° C. or lower, adding a certain amount of a phenolic epoxy resin and an accelerator, uniformly stirring the mixture, and using a 10,000-mesh filter bag for pressure filtration into a clean barrel for sealing and packaging.

According to another embodiment, the disclosure provides a method for preparing a corona-resistant enameled round wire, the method comprising: providing a copper conductor; and sequentially coating the copper conductor with a first corona-resistant polyamideimide coating, a corona-resistant special resin coating, a corona-resistant polyimide coating, a corona-resistant modified silicone resin coating, and a second corona-resistant polyamideimide coating to form a copper conductor coated with an insulating layer, thereby preparing the corona-resistant enameled round wire.

The above-mentioned technical solutions of the disclosure have the following beneficial technical effects:

Compared with the prior art, the disclosure has the following advantages: the PDIV/PDEV value of the enameled round wire is obviously improved, which is improved by 20% or more than that of conventional techniques. The corona resistance lifetime is excellent, and the corona resistance lifetime is more than 80 hours. The paint film has a good high-temperature resistance and meets the requirements of temperature resistance grades at 22° C. or more. The paint film has excellent adhesion, bending resistance and a good ductility, and is convenient for winding embedding for drive motors with a high slot fill factor.

Reference signs:

1: copper conductor; 2: insulating layer; 3: corona-resistant polyamideimide coating; 4: corona-resistant special resin coating; 5: corona-resistant polyimide coating; 6: corona-resistant modified silicone resin coating; and 7: corona-resistant polyamideimide coating.

DETAILED DESCRIPTION OF EMBODIMENTS

In order to make the objectives, technical solutions and advantages of the disclosure clearer, the disclosure will be further illustrated in detail below in conjunction with specific embodiments and with reference to the accompanying drawings. It should be understood that such descriptions are exemplary only and are not intended to limit the scope of the disclosure. In addition, in the following illustration, the description of well-known structures and techniques is omitted to avoid unnecessarily obscuring the concepts of the disclosure.

A schematic diagram of a layered structure according to an embodiment of the disclosure is shown in the accompanying drawings. These figures are not drawn to scale, some details are enlarged for the purpose of clarity, and some details may have been omitted. The shapes of various regions and layers and the relative sizes and positional relationships thereof, as shown in the figures, are only exemplary, and may vary in practice due to manufacturing tolerances or technical limitations, and those skilled in the art can additionally design regions/layers with different shapes, sizes, and relative positions according to actual needs.

Obviously, the described embodiments are some, rather than all, of the embodiments of the disclosure. Based on the embodiments of the disclosure, other embodiments obtained by those of ordinary skill in the art without involving any inventive effort shall all fall within the scope of protection of the disclosure.

In addition, the technical features involved in the various embodiments of the disclosure, as described below, can be combined with each other as long as there is no conflict with each other.

The disclosure will be described in more detail below with reference to the accompanying drawings. In the various figures, like elements are designated by like reference signs. For clarity, various parts in the figures are not drawn to scale.

Figure 1:
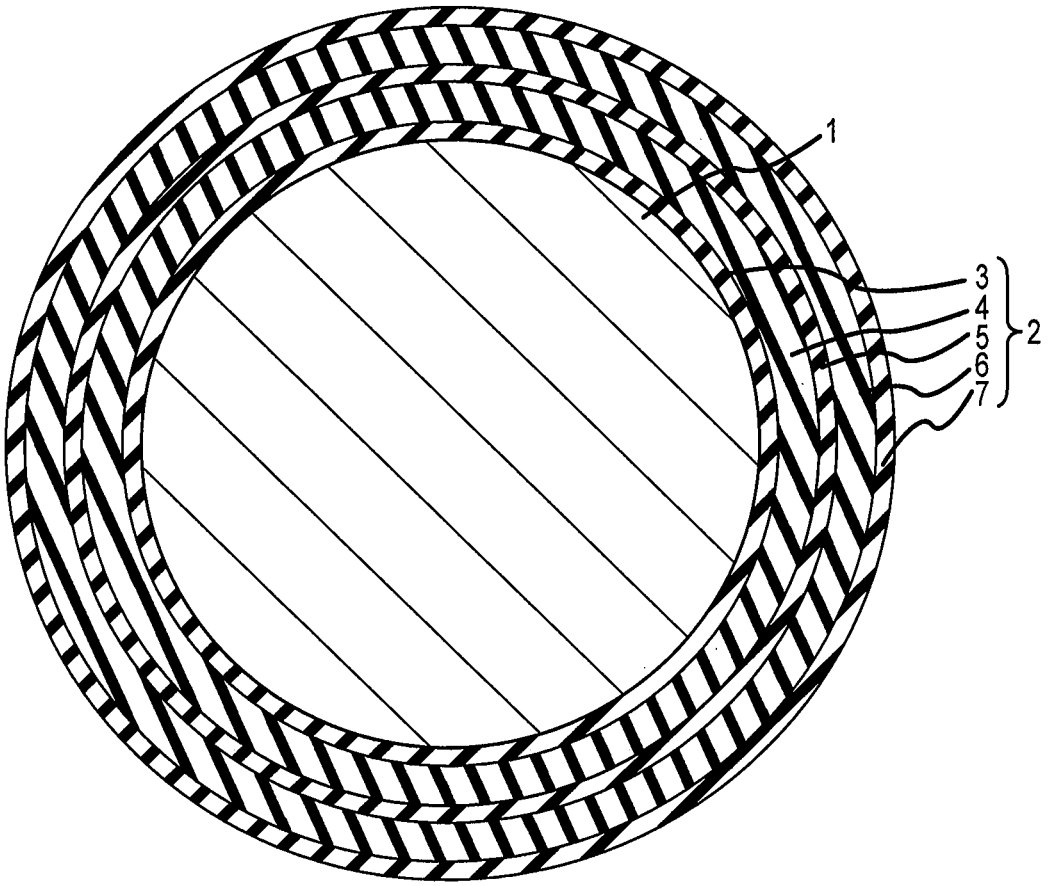
FIG. 1 is a schematic cross-sectional view of a corona-resistant enameled round wire proposed according to an embodiment of the disclosure.

In Example 1, the disclosure provided a corona-resistant enameled round wire suitable for electric vehicle motors with a high PDIV/PDEV value. Referring to FIG. 1, it was a schematic cross-sectional view of a corona-resistant enameled round wire provided according to an embodiment of the disclosure, the corona-resistant enameled round wire as shown in FIG. 1 comprised a copper conductor 1 and an insulating layer 2 and was prepared by means of the following steps.

Figure 2:
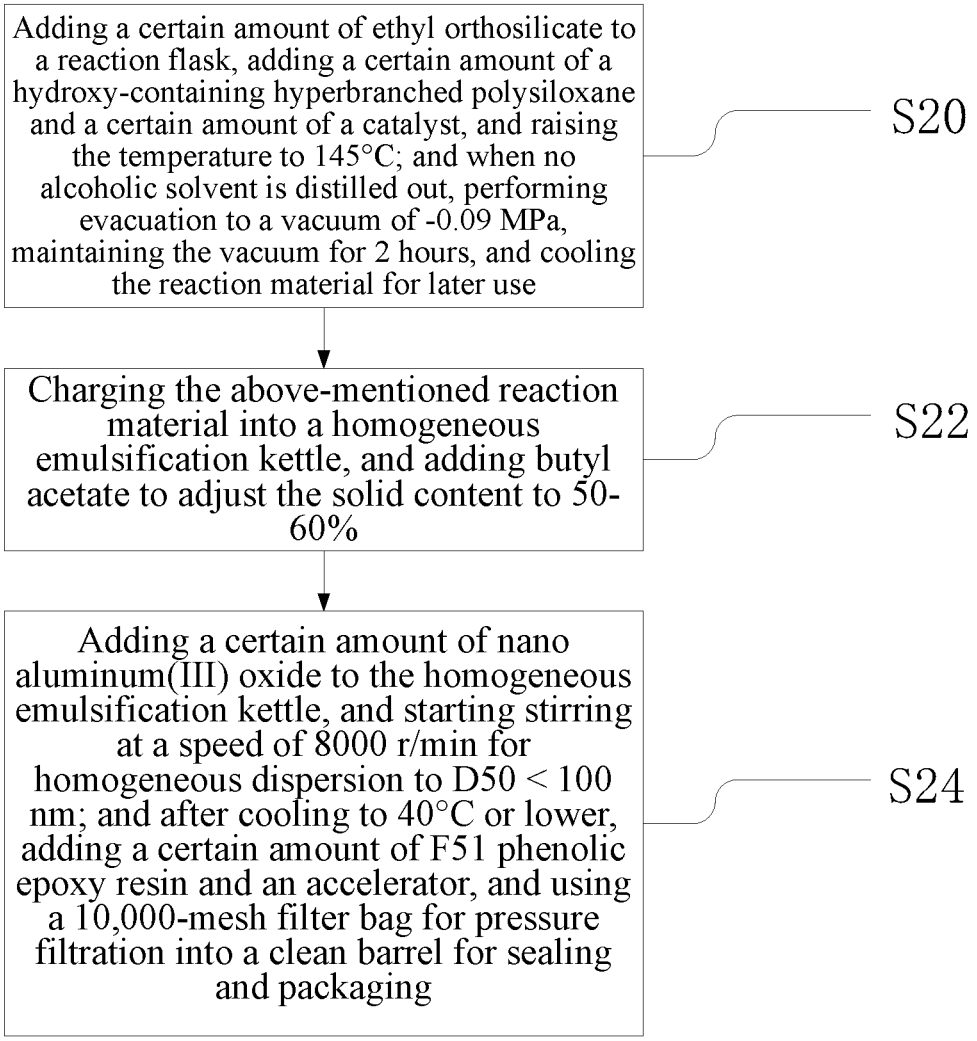
FIG. 2 is a flow chart of a method for preparing a corona-resistant modified silicone resin coating for a corona-resistant enameled round wire according to an embodiment of the disclosure.

During horizontal enameled round wire production, a corona-resistant enameled round wire was prepared on line using a polycrystalline material paint mold, wherein the annealing temperature for a copper wire was 500° C/470° C., the curing temperature in a drying tunnel was 550° C., and the production DV value was 53. The wire gauge was 0.8 mm The wire was sequentially coated with a corona-resistant polyamideimide coating 3, a corona-resistant special resin coating 4, a corona-resistant polyimide coating 5, a corona-resistant modified silicone resin coating 6, and a corona-resistant polyamideimide coating 7 to form a copper conductor 1 coated with an insulating layer 2, wherein the coating thickness percentages thereof were respectively 18%, 19%, 11%, 30%, and 22%, and the bilateral overall thickness of the paint film was 0.13 mm The corona-resistant polyamideimide coating 3, the corona-resistant polyimide coating 5, and the corona-resistant polyamideimide coating 7 could be formed by means of coating with a corona-resistant polyamideimide/polyimide paint prepared by modification with nano-silica, aluminum(III) oxide or a combination thereof The corona-resistant special resin coating 4 could be a nano-silica-modified polyether sulfone coating. The preparation method for the corona-resistant modified silicone resin coating 6 was as shown in FIG. 2, wherein step S20 could preferably involve adding a hydroxy-containing polysiloxane with a fraction of 30-100% relative to the mass of ethyl orthosilicate or butyl orthosilicate and 0.01-0.2% of a catalyst with a fraction relative to the total material mass (without limitation).

Step S20: 5000 g of ethyl orthosilicate was added to a reaction flask, stirring was started, 3150 g of a hydroxy-containing hyperbranched polysiloxane and 2.5 g of stannous chloride were added, and the temperature was raised to 145° C.; and when no alcoholic solvent was distilled out, evacuation was performed to a vacuum of −0.09 MPa, the vacuum was maintained for 2 hours, and the reaction material was cooled for later use;

Step S22: 3500 g of the above-mentioned reaction material was weighed and charged into a sealed homogeneous emulsification kettle, 3340 g of butyl acetate was added, and the mixture was uniformly stirred to adjust the solid content to 50-60%; and Step S24: 1104 g of nano aluminum(III) oxide with an average particle size of 50 nm was added to the sealed homogeneous emulsification kettle, and stirring was started at a speed of 8000 r/min (cooling with jacket cooling water in the kettle was started to ensure that the temperature of the material in the kettle was less than 60° C.) for homogeneous dispersion to D50<100 nm; and after cooling to 40° C. or lower, 1300 g of F51 phenolic epoxy resin and 1.44 g of boron trifluoride diethyl ether were added and uniformly stirred, and a 10,000-mesh filter bag was used for pressure filtration into a clean barrel for sealing and packaging.

In Example 2, the disclosure provided a corona-resistant enameled round wire suitable for electric vehicle motors with a high PDIV/PDEV value, which was prepared by means of the following steps.

Figure 3:
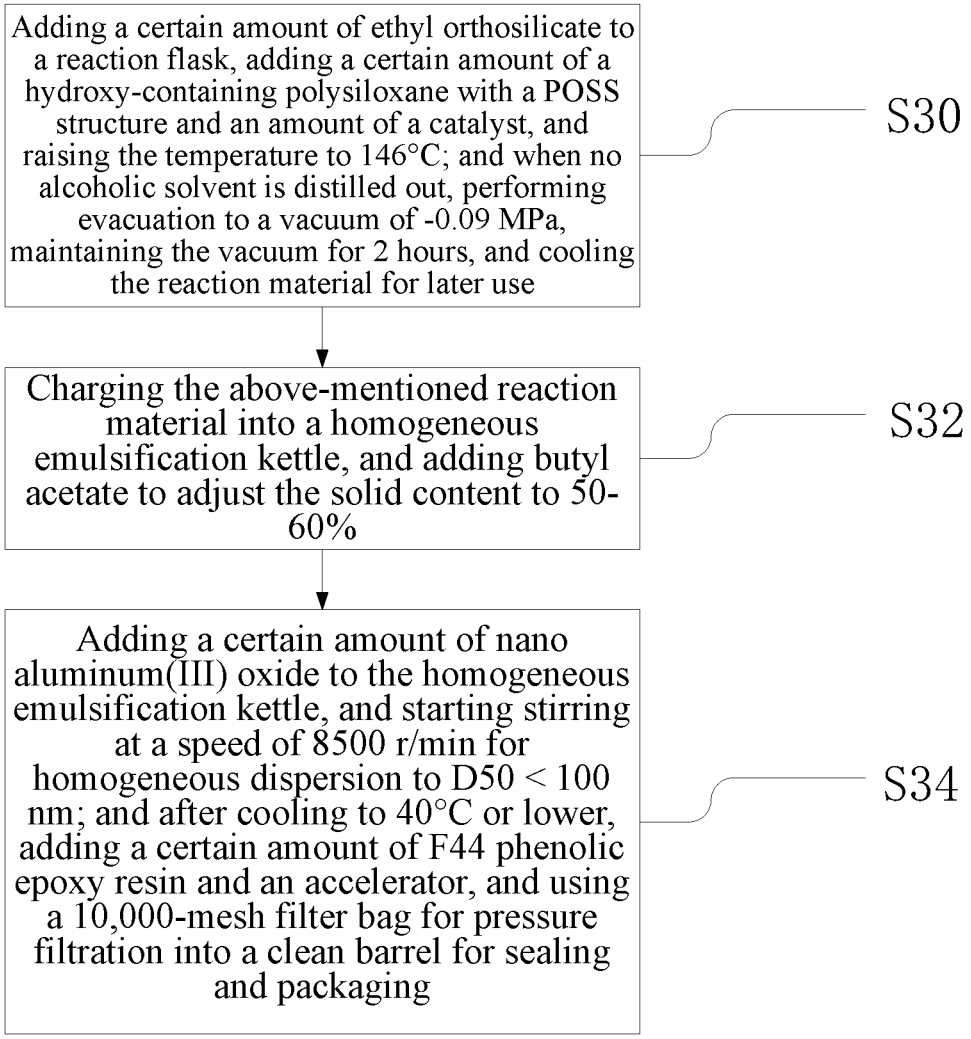
FIG. 3 is a flow chart of a method for preparing a corona-resistant modified silicone resin coating for a corona-resistant enameled round wire according to another embodiment of the disclosure.

During horizontal enameled round wire production, a corona-resistant enameled round wire was prepared on line using a polycrystalline material paint mold, wherein the annealing temperature for a copper wire was 500° C/470° C., the curing temperature in a drying tunnel was 550° C., and the production DV value was 53. The wire gauge was 0.8 mm The wire was sequentially coated with a corona-resistant polyamideimide coating 3, a corona-resistant special resin coating 4, a corona-resistant polyimide coating 5, a corona-resistant modified silicone resin coating 6, and a corona-resistant polyamideimide coating 7 to form a copper conductor 1 coated with an insulating layer 2, wherein the coating thickness percentages thereof were respectively 15%, 22%, 13%, 31%, and 19%, and the bilateral overall thickness of the paint film was 0.13 mm The corona-resistant polyamideimide coating 3, the corona-resistant polyimide coating 5, and the corona-resistant polyamideimide coating 7 could be formed by means of coating with a corona-resistant polyamideimide/polyimide paint prepared by modification with nano-silica, aluminum(III) oxide or a combination thereof The corona-resistant special resin coating 4 could be a nano-aluminum(III)-oxide-modified heteronaphthalene diphenyl polyether nitrile sulfone coating. The preparation method for the corona-resistant modified silicone resin coating 6 was as shown in FIG. 3, wherein step S30 could preferably involve adding a hydroxy-containing polysiloxane with a fraction of 30-100% relative to the mass of ethyl orthosilicate or butyl orthosilicate and 0.01-0.2% of a catalyst with a fraction relative to the total material mass (without limitation).

Step S30: 6200 g of butyl orthosilicate was added to a reaction flask, stirring was started, 4530 g of a hydroxy-containing polysiloxane with a polyhedral oligomeric silsesquioxane (POSS) structure and 3.2 g of stannous chloride were added, and the temperature was raised to 146° C.; and when no alcoholic solvent was distilled out, evacuation was performed to a vacuum of −0.09 MPa, the vacuum was maintained for 2 hours, and the reaction material was cooled for later use;

Step S32: 5000 g of the above-mentioned reaction material was weighed and charged into a sealed homogeneous emulsification kettle, 4890 g of butyl acetate was added, and the mixture was uniformly stirred to adjust the solid content to 50-60%; and Step S34: 1570 g of nano-silica with an average particle size of 45 nm was added to the sealed homogeneous emulsification kettle, and stirring was started at a speed of 8500 r/min (cooling with jacket cooling water in the kettle was started to ensure that the temperature of the material in the kettle was less than 60° C.) for homogeneous dispersion to D50<100 nm; and after cooling to 40° C. or lower, 2200 g of F44 phenolic epoxy resin and 2.16 g of boron trifluoride ethylamine were added and uniformly stirred, and a 10,000-mesh filter bag was used for pressure filtration into a clean barrel for sealing and packaging.

In Example 3, the disclosure provided a corona-resistant enameled round wire suitable for electric vehicle motors with a high PDIV/PDEV value, which was prepared by means of the following steps.

Figure 4:
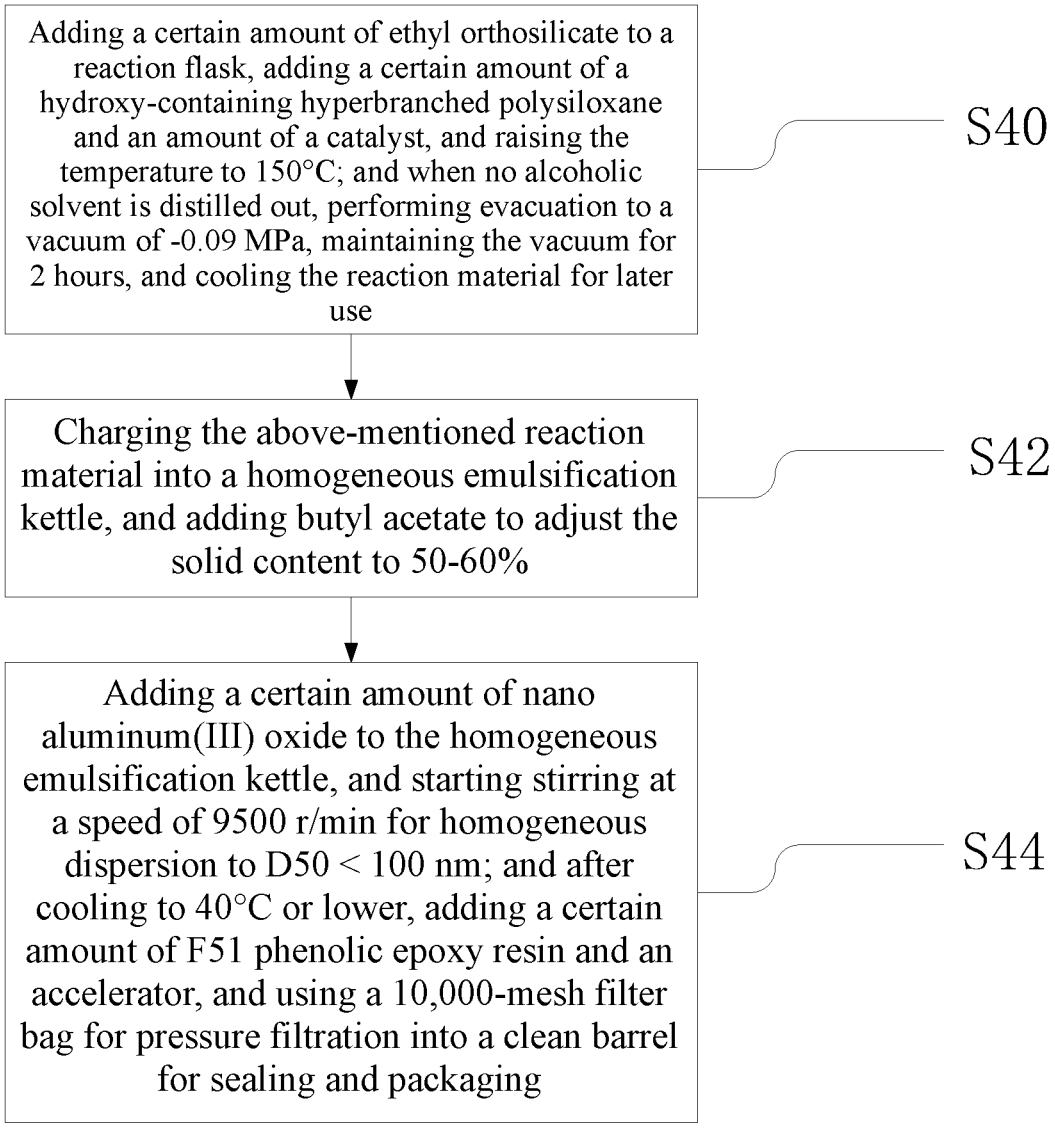
FIG. 4 is a flow chart of a method for preparing a corona-resistant modified silicone resin coating for a corona-resistant enameled round wire according to another embodiment of the disclosure.

During horizontal enameled round wire production, a corona-resistant enameled round wire was prepared on line using a polycrystalline material paint mold, wherein the annealing temperature for a copper wire was 500° C/470° C., the curing temperature in a drying tunnel was 550° C., and the production DV value was 53. The wire gauge was 0.8 mm The wire was sequentially coated with a corona-resistant polyamideimide coating 3, a corona-resistant special resin coating 4, a corona-resistant polyimide coating 5, a corona-resistant modified silicone resin coating 6, and a corona-resistant polyamideimide coating 7 to form a copper conductor 1 coated with an insulating layer 2, wherein the coating thickness percentages thereof were respectively 16%, 23%, 12%, 30%, and 19%, and the bilateral overall thickness of the paint film was 0.13 mm The corona-resistant polyamideimide coating 3, the corona-resistant polyimide coating 5, and the corona-resistant polyamideimide coating 7 could be formed by means of coating with a corona-resistant polyamideimide/polyimide paint prepared by modification with nano-silica, aluminum (III) oxide or a combination thereof. The corona-resistant special resin coating 4 was a nano-aluminum(III)-oxide-modified polyether sulfone coating. The preparation method for the corona-resistant modified silicone resin coating 6 was as shown in FIG. 4, wherein step S40 could preferably involve adding a hydroxy-containing polysiloxane with a fraction of 30-100% relative to the mass of ethyl orthosilicate or butyl orthosilicate and 0.01-0.2% of a catalyst with a fraction relative to the total material mass (without limitation).

Step S40: 4500 g of ethyl orthosilicate was added to a reaction flask, stirring was started, 3600 g of a hydroxy-containing hyperbranched polysiloxane and 2.3 g of stannous chloride were added, and the temperature was raised to 150° C.; and when no alcoholic solvent was distilled out, evacuation was performed to a vacuum of −0.09 MPa, the vacuum was maintained for 2 hours, and the reaction material was cooled for later use;

Step S42: 3000 g of the above-mentioned reaction material was weighed and charged into a sealed homogeneous emulsification kettle, 2172 g of butyl acetate was added, and the mixture was uniformly stirred to adjust the solid content to 50-60%; and Step S44: 890 g of nano-silica with an average particle size of 52 nm was added to the sealed homogeneous emulsification kettle, and stirring was started at a speed of 9500 r/min (cooling with jacket cooling water in the kettle was started to ensure that the temperature of the material in the kettle was less than 60° C.) for homogeneous dispersion to D50<100 nm; and after cooling to 40° C. or lower, 1280 g of F51 phenolic epoxy resin and 1.2 g of an epoxy resin curing accelerator (DMP-30) were added and uniformly stirred, and a 10,000-mesh filter bag was used for pressure filtration into a clean barrel for sealing and packaging.

In Comparative Example 1, during horizontal enameled round wire production, a corona-resistant enameled round wire was prepared on line using a polycrystalline material paint mold, wherein the annealing temperature for a copper wire was 500° C/470° C., the curing temperature in a drying tunnel was 550° C., and the production DV value was 53. The wire gauge was 0.8 mm The wire was sequentially coated with a corona-resistant polyesterimide coating and a polyamideimide coating, wherein the coating thickness percentages thereof were respectively 85% and 15% (conventional composite coating-based corona-resistant enameled round wire on the market), and the bilateral overall thickness of the paint film was 0.13 mm.

In Comparative Example 2, during horizontal enameled round wire production, a corona-resistant enameled round wire was prepared on line using a polycrystalline material paint mold, wherein the annealing temperature for a copper wire was 500° C/470° C., the curing temperature in a drying tunnel was 550° C., and the production DV value was 53. The wire gauge was 0.8 mm The wire was coated with a corona-resistant polyamideimide single coating (prepared by coating with a corona-resistant single coating polyamideimide paint), and the bilateral overall thickness of the paint film was 0.13 mm.

The properties of the corona-resistant enameled round wires of Examples 1-3 and Comparative Examples 1 and 2 were tested, and the results were shown in Table 1.

TABLE 1

Comparison of the properties of impregnating resins in Examples 1-3 and Comparative Examples 1 and 2

| Performance indicator | Example 1 | Example 2 | Example 3 | Comparative Example 1 | Comparative Example 2 |
|---|---|---|---|---|---|
| Quick break test | No loss of adhesion | No loss of adhesion | No loss of adhesion | No loss of adhesion | No loss of adhesion |
| Bending test (After tightly wrapping 10 turns on a 1d round rod, no paint layer cracking should occur) | No cracking | No cracking | No cracking | No cracking | No cracking |
| PDIV (V) | 1030 | 1080 | 1056 | 736 | 805 |
| PDEV (V) | 959 | 916 | 983 | 516 | 532 |
| Corona resistance lifetime (h:min) | 85:39 | 86:21 | 87:26 | 56:52 | 68:36 |

In the PDIV value test, background noise<5 pc; and the corona resistance lifetime test conditions were: testing in a high-frequency pulse test, a waveform square wave, a temperature of 155° C., a frequency of 20 kHz, a pulse time of 100 ns, and a voltage of 3000 V.

Due to the implementation of Examples 1-3 mentioned above, the disclosure has the following advantages as compared with the prior art: the PDIV/PDEV value of the enameled round wire is obviously improved, which is improved by 20% or more than that of conventional techniques. The corona resistance lifetime is excellent, and the corona resistance lifetime is more than 80 hours. The paint film has a good high-temperature resistance and meets the requirements of temperature resistance grades at 220° C. or more. The paint film has excellent adhesion, bending resistance and a good ductility, and is convenient for winding embedding for drive motors with a high slot fill factor.

It should be understood that the above-mentioned specific embodiments of the disclosure are only used for illustrating or explaining, by way of example, the principles of the disclosure, rather than limiting the disclosure. Therefore, any modifications, equivalent replacements, improvements, etc. made without departing from the spirit and scope of the disclosure should all be included within the scope of protection of the disclosure. Furthermore, the appended claims of the disclosure are intended to cover all changes and modifications that fall within the scope and boundaries of the appended claims, or equivalents of such scope and boundaries.

The invention claimed is:

1. A corona-resistant enameled round wire suitable for electric vehicle motors, the corona-resistant enameled round wire comprising:

a copper conductor; and an insulating layer that clads the copper conductor and comprises, in sequence from inside to outside, a first corona-resistant polyamideimide coating, a corona-resistant special resin coating, a corona-resistant polyimide coating, a corona-resistant modified silicone resin coating, and a second corona-resistant polyamideimide coating.

2. The corona-resistant enameled round wire according to claim 1, wherein the thickness percentages of the first corona-resistant polyamideimide coating, the corona-resistant special resin coating, the corona-resistant polyimide coating, the corona-resistant modified silicone resin coating, and the second corona-resistant polyamideimide coating are respectively 10-20%, 10-25%, 5-15%, 25-35%, and 10-25%.

3. The corona-resistant enameled round wire according to claim 2, wherein the first corona-resistant polyamideimide coating, the corona-resistant polyimide coating, and the second corona-resistant polyamideimide coating are formed by means of coating with a corona-resistant polyamideimide/polyimide paint prepared by modification with nano-silica, aluminum(III) oxide or a combination thereof.

4. The corona-resistant enameled round wire according to claim 2, wherein the corona-resistant special resin coating is formed by means of coating with a corona-resistant special resin paint liquid prepared by modification with nano-silica, aluminum(III) oxide or a combination thereof.

5. The corona-resistant enameled round wire according to claim 2, wherein the corona-resistant modified silicone resin coating is prepared by means of a preparation method involving:

adding a certain amount of ethyl orthosilicate or butyl orthosilicate to a reaction flask, starting stirring, adding a hydroxy-containing polysiloxane with a fraction of 30-100% relative to the mass of the ethyl orthosilicate or butyl orthosilicate, and a catalyst with a fraction of 0.01-0.2% relative to the total material mass, raising the temperature to 140-150° C., and maintaining the temperature for a reaction; and when no alcoholic solvent is distilled out, performing evacuation to a vacuum of −0.09 MPa or more, maintaining the vacuum for 1-2 hours, and cooling the reaction material for later use;

charging the material into a sealed homogeneous emulsification kettle, and adding butyl acetate to adjust the solid content to 50-60%; and adding a certain amount of a nano-powder to the homogeneous emulsification kettle, starting stirring at a speed of 8000-12000 r/min for homogeneous dispersion to D50<100 nm, and starting cooling with jacket cooling water in the kettle to make the temperature of the material in the kettle be 60° C. or lower; and after cooling to 40° C. or lower, adding a certain amount of a phenolic epoxy resin and an accelerator, uniformly stirring the mixture, and using a 10,000-mesh filter bag for pressure filtration into a clean barrel for sealing and packaging.

6. The corona-resistant enameled round wire according to claim 1, wherein the first corona-resistant polyamideimide coating, the corona-resistant polyimide coating, and the second corona-resistant polyamideimide coating are formed by means of coating with a corona-resistant polyamideimide/polyimide paint prepared by modification with nano-silica, aluminum(III) oxide or a combination thereof.

7. The corona-resistant enameled round wire according to claim 1, wherein the corona-resistant special resin coating is formed by means of coating with a corona-resistant special resin paint liquid prepared by modification with nano-silica, aluminum(III) oxide or a combination thereof.

8. The corona-resistant enameled round wire according to claim 7, wherein the corona-resistant special resin paint liquid is selected from benzoxazine, polyarylene ether nitrile, polyarylene ether nitrile sulfone, polyether sulfone, modified polyether ether ketone, a cyanate ester prepolymer or a combination thereof.

9. The corona-resistant enameled round wire according to claim 1, wherein the corona-resistant modified silicone resin coating is prepared by means of a preparation method involving:

adding a certain amount of ethyl orthosilicate or butyl orthosilicate to a reaction flask, starting stirring, adding a hydroxy-containing polysiloxane with a fraction of 30-100% relative to the mass of the ethyl orthosilicate or butyl orthosilicate, and a catalyst with a fraction of 0.01-0.2% relative to the total material mass, raising the temperature to 140-150° C., and maintaining the temperature for a reaction; and when no alcoholic solvent is distilled out, performing evacuation to a vacuum of −0.09 MPa or more, maintaining the vacuum for 1-2 hours, and cooling the reaction material for later use;

charging the material into a sealed homogeneous emulsification kettle, and adding butyl acetate to adjust the solid content to 50-60%; and adding a certain amount of a nano-powder to the homogeneous emulsification kettle, starting stirring at a speed of 8000-12000 r/min for homogeneous dispersion to D50<100 nm, and starting cooling with jacket cooling water in the kettle to make the temperature of the material in the kettle be 60° C. or lower; and after cooling to 40° C. or lower, adding a certain amount of a phenolic epoxy resin and an accelerator, uniformly stirring the mixture, and using a 10,000-mesh filter bag for pressure filtration into a clean barrel for sealing and packaging.

10. A method for preparing a corona-resistant enameled round wire, the method comprising:

providing a copper conductor; and sequentially coating the copper conductor with a first corona-resistant polyamideimide coating, a corona-resistant special resin coating, a corona-resistant polyimide coating, a corona-resistant modified silicone resin coating, and a second corona-resistant polyamideimide coating to form a copper conductor coated with an insulating layer, thereby preparing the corona-resistant enameled round wire.

11. The method for preparing a corona-resistant enameled round wire according to claim 10, wherein the thickness percentages of the first corona-resistant polyamideimide coating, the corona-resistant special resin coating, the corona-resistant polyimide coating, the corona-resistant modified silicone resin coating, and the second corona-resistant polyamideimide coating are respectively 10-20%, 10-25%, 5-15%, 25-35%, and 10-25%.

12. The method for preparing a corona-resistant enameled round wire according to claim 1, wherein the first corona-resistant polyamideimide coating, the corona-resistant polyimide coating, and the second corona-resistant polyamideimide coating are formed by means of coating with a corona-resistant polyamideimide/polyimide paint prepared by modification with nano-silica, aluminum(III) oxide or a combination thereof.

13. The method for preparing a corona-resistant enameled round wire according to claim 11, wherein the corona-resistant special resin coating is formed by means of coating with a corona-resistant special resin paint liquid prepared by modification with nano-silica, aluminum(III) oxide or a combination thereof.

14. The method for preparing a corona-resistant enameled round wire according to claim 11, wherein the corona-resistant modified silicone resin coating is prepared by means of a preparation method involving:

adding a certain amount of ethyl orthosilicate or butyl orthosilicate to a reaction flask, starting stirring, adding a certain amount of a hydroxy-containing polysiloxane and an amount of a catalyst, raising the temperature to 140150° C., and maintaining the temperature for a reaction; and when no alcoholic solvent is distilled out, performing evacuation to a vacuum of −0.09 MPa or more, maintaining the vacuum for 1-2 hours, and cooling the reaction material for later use;

charging the material into a sealed homogeneous emulsification kettle, and adding butyl acetate to adjust the solid content to 50-60%; and adding a certain amount of a nano-powder to the homogeneous emulsification kettle, starting stirring at a speed of 8000-12000 r/min for homogeneous dispersion to D50<100 nm, and starting cooling with jacket cooling water in the kettle to cause the temperature of the material in the kettle to be 60° C. or lower; and after cooling to 40° C. or lower, adding a certain amount of a phenolic epoxy resin and an accelerator, uniformly stirring the mixture, and using a 10,000-mesh filter bag for pressure filtration into a clean barrel for sealing and packaging.

15. The method for preparing a corona-resistant enameled round wire according to claim 10, wherein the first corona-resistant polyamideimide coating, the corona-resistant polyimide coating, and the second corona-resistant polyamideimide coating are formed by means of coating with a corona-resistant polyamideimide/polyimide paint prepared by modification with nano-silica, aluminum(III) oxide or a combination thereof.

16. The method for preparing a corona-resistant enameled round wire according to claim 7, wherein the corona-resistant special resin coating is formed by means of coating with a corona-resistant special resin paint liquid prepared by modification with nano-silica, aluminum(III) oxide or a combination thereof.

17. The method for preparing a corona-resistant enameled round wire according to claim 16, wherein the corona-resistant special resin paint liquid is selected from benzoxazine, polyarylene ether nitrile, polyarylene ether nitrile sulfone, polyether sulfone, modified polyether ether ketone, a cyanate ester prepolymer or a combination thereof.

18. The method for preparing a corona-resistant enameled round wire according to claim 10, wherein the corona-resistant modified silicone resin coating is prepared by means of a preparation method involving:

adding a certain amount of ethyl orthosilicate or butyl orthosilicate to a reaction flask, starting stirring, adding a certain amount of a hydroxy-containing polysiloxane and an amount of a catalyst, raising the temperature to 140-150° C., and maintaining the temperature for a reaction; and when no alcoholic solvent is distilled out, performing evacuation to a vacuum of −0.09 MPa or more, maintaining the vacuum for 1-2 hours, and cooling the reaction material for later use;

charging the material into a sealed homogeneous emulsification kettle, and adding butyl acetate to adjust the solid content to 50-60%; and adding a certain amount of a nano-powder to the homogeneous emulsification kettle, starting stirring at a speed of 8000-12000 r/min for homogeneous dispersion to D50<100 nm, and starting cooling with jacket cooling water in the kettle to cause the temperature of the material in the kettle to be 60° C. or lower; and after cooling to 40° C. or lower, adding a certain amount of a phenolic epoxy resin and an accelerator, uniformly stirring the mixture, and using a 10,000-mesh filter bag for pressure filtration into a clean barrel for sealing and packaging.

* * * * *